US009505466B2

(12) United States Patent
Robertsson et al.

(10) Patent No.: US 9,505,466 B2
(45) Date of Patent: Nov. 29, 2016

(54) METHOD OF MOORING A SHIP AND ARRANGEMENT TO ACCOMPLISH THE METHOD

(71) Applicants: STENA REDERI AB, Göteborg (SE); REMORA AS, Stavanger (NO)

(72) Inventors: Harry Robertsson, Västra Frölunda (SE); Svein B. Hellesmark, Fevik (NO)

(73) Assignee: Stena Rederi AB, Göteborg (SE)

( * ) Notice: Subject to any disclaimer, the term of this patent is extended or adjusted under 35 U.S.C. 154(b) by 30 days.

(21) Appl. No.: 14/423,237

(22) PCT Filed: Jul. 30, 2013

(86) PCT No.: PCT/SE2013/050941

§ 371 (c)(1),
(2) Date: Feb. 23, 2015

(87) PCT Pub. No.: WO2014/031061

PCT Pub. Date: Feb. 27, 2014

(65) Prior Publication Data

US 2015/0210361 A1 Jul. 30, 2015

(30) Foreign Application Priority Data

Aug. 24, 2012 (SE) ..... 1250952

(51) Int. Cl.

| | |
|---|---|
| ***B63B 22/02*** | (2006.01) |
| ***B63B 21/50*** | (2006.01) |
| *B63B 3/14* | (2006.01) |

(52) U.S. Cl.

CPC ..... *B63B 22/02* (2013.01); *B63B 21/50* (2013.01); *B63B 21/508* (2013.01); *B63B 2003/147* (2013.01); *B63B 2022/028* (2013.01)

(58) Field of Classification Search

CPC ..... B63B 21/50; B63B 22/02
USPC ..... 441/3; 114/230.1–230.26
See application file for complete search history.

(56) References Cited

U.S. PATENT DOCUMENTS 3,902,447 A * 9/1975 Slocum ..... B63B 21/50 114/230.26
5,381,750 A * 1/1995 Pollack ..... B63B 21/507 114/230.12

(Continued)

FOREIGN PATENT DOCUMENTS

MC WO 2012032163 A1 * 3/2012 ..... B63B 21/508
NO WO 9938763 A1 * 8/1999 ..... B63B 21/507

(Continued)

OTHER PUBLICATIONS

Sweden Patent and Registration Office, Int'l Search Report in PCT/SE2013/050941, Nov. 25, 2013.

*Primary Examiner* — Lars A Olson
*Assistant Examiner* — Jovon Hayes
(74) *Attorney, Agent, or Firm* — Piedmont Intellectual Property

(57) ABSTRACT

Methods and arrangements of releasably mooring a ship in a definite position at a distance from land with an ability to return later to the same place. The mooring is accomplished by means of a substantially ring-shaped mooring unit, which can be raised and lowered and which has a gap along its periphery, which can be connected to and disconnected from the ship by a connectable part located below the surface of the water. The mooring unit enables a ship carrying a downwardly protruding load to pass by after disconnection and lowering of the mooring unit, and to be rotated round an essentially vertical imaginary axis.

12 Claims, 7 Drawing Sheets

(56) References Cited

U.S. PATENT DOCUMENTS

Figure 1:
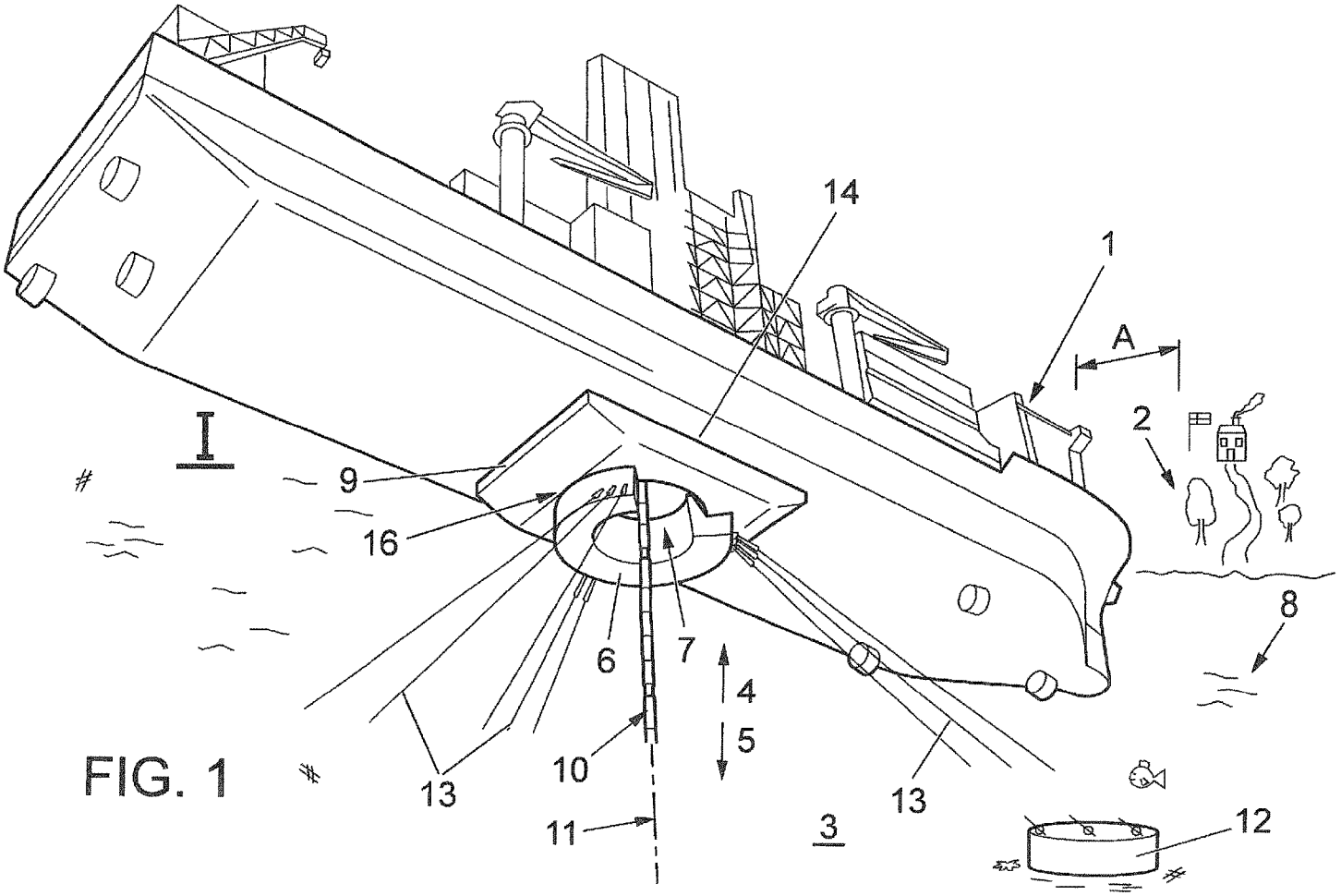

| | | | | |
|---|---|---|---|---|
| 7,513,208 | B1 * | 4/2009 | Seaman | B63B 21/508 114/230.12 |
| 9,315,242 | B2 * | 4/2016 | Veselis | B63B 22/02 |
| 2011/0130057 | A1 * | 6/2011 | Denise | B63B 21/508 441/5 |
| 2013/0183876 | A1 * | 7/2013 | Veselis | B63B 22/02 441/3 |
| 2015/0210361 | A1 * | 7/2015 | Robertsson | B63B 21/508 441/3 |

FOREIGN PATENT DOCUMENTS

| | | | |
|---|---|---|---|
| WO | 99/38763 | A1 | 8/1999 |
| WO | 2011/047736 | A1 | 4/2011 |
| WO | 2012/032163 | A1 | 3/2012 |

* cited by examiner

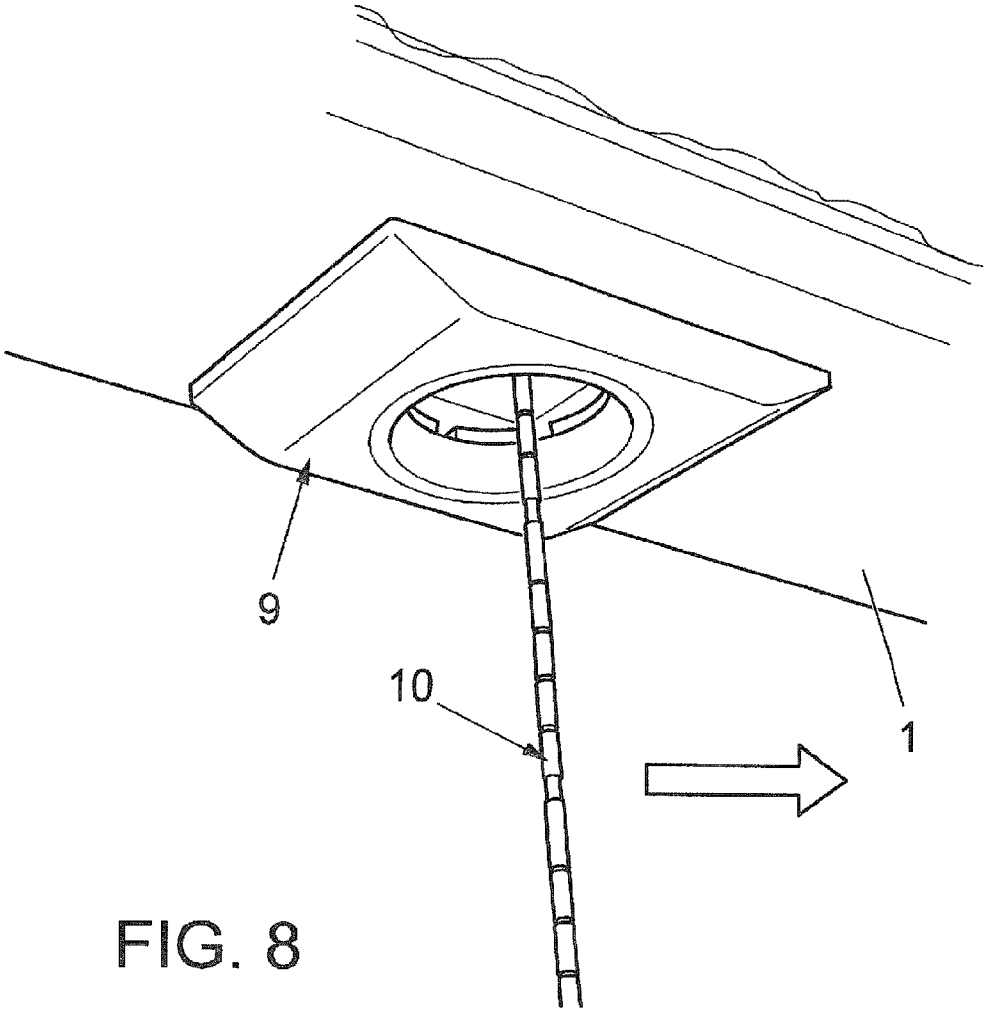
FIG. 8
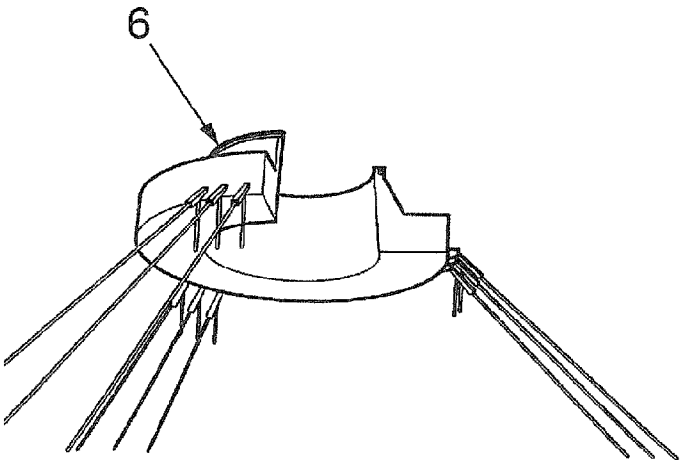

METHOD OF MOORING A SHIP AND ARRANGEMENT TO ACCOMPLISH THE METHOD

The present invention relates to a method of accomplishing mooring of ship in a definite position at a distance from land and with possibility to make the ship leave its moorage in question.

For floating vessels Dynamic Positioning (DP) and/or mooring systems are used in order to prevent the vessel from moving, i.e. to keep it in a definite position. Depending on the assignment of the ship and the water depth in question, various demands are made as to the immobility of the ship or, inversely, demands on the maximum allowed deviation from the definite position.

The capability of the ship of keeping the definite position depends on the reaction time of the DP-system to counteract the environmental forces arising from wind, waves and currents. In certain waters the ship might also be affected by forces caused by drift ice. The DP-system consists of thrusters, i.e. propulsors which can be rotated 360 degrees in the horizontal plane, and one or several reference systems for definition of the definite position. The thrusters generate a resulting force, which counteracts the environmental forces, so that the definite position of the ship is maintained.

In certain operation areas there might be restrictions concerning emissions. Reduction of the power necessary to keep the ship in the definite position increases the availability by reduced emissions.

A complication when mooring of for example ships adapted to drill into the sea bed is that certain situations might require that the ship in question can be disconnected in a controlled way at relatively short notice and leave the definite position, and after some time can be connected to the mooring system again.

A further complication is that during certain operations a steel pipe, a so called "riser", is used between a valve at the sea bed and the ship. To take up the "riser" before it is disconnected is too time-consuming, why it is necessary to design the arrangement so that disconnection can be effected without it being necessary to take up the "riser" to the ship.

The main object of the present invention is, therefore, in the first place to solve among other things said problems in an effective way by means of simple and well working means.

Said object is reached by means of a method according to the way indicated, which is mainly characterized in that the mooring is accomplished by means of a substantially ring-shaped mooring unit, which can be raised and lowered and which has a gap along the periphery, and which can be connected to and disconnected from the ship, respectively, by means of a connectable part located below the surface of the water, and which mooring unit makes it possible for the ship, with downwards protruding load supported by the ship, to pass by after disconnection and lowering of said mooring unit and to be rotated round an essentially vertical imaginary axis.

A further problem with the invention is to find means, which can be applied effectively and safely when carrying out a method according to the invention.

Said means are included by an arrangement, which is mainly characterized in that a substantially ring-shaped mooring unit, which can be raised and lowered and which has a gap along the periphery, is provided with means so that it can be releasably connected to and disconnected from the ship in question, respectively, below the surface of the water, and so it can be rotated in relation to the ship round an essentially vertical imaginary axis.

Figure 2:
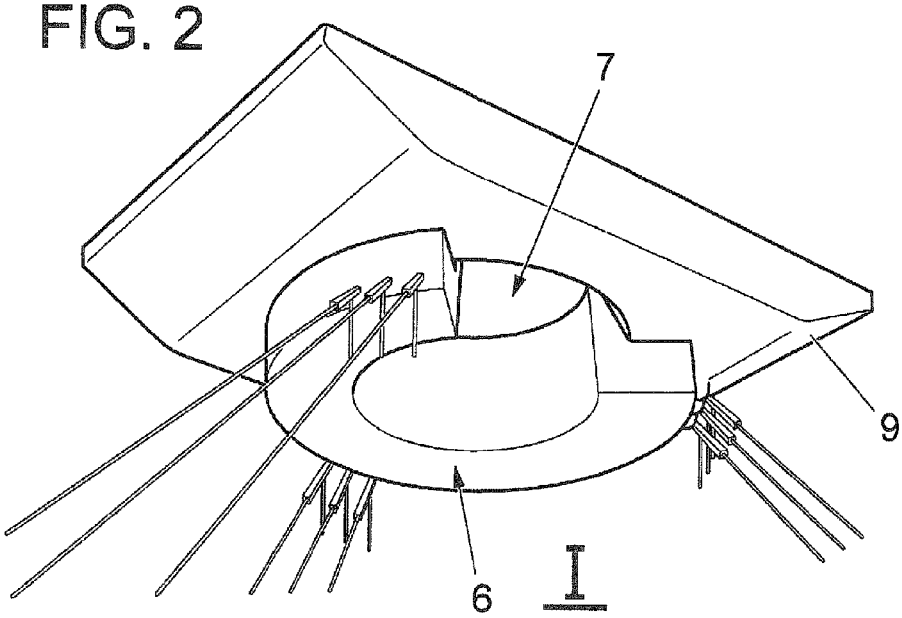
Figure 3:
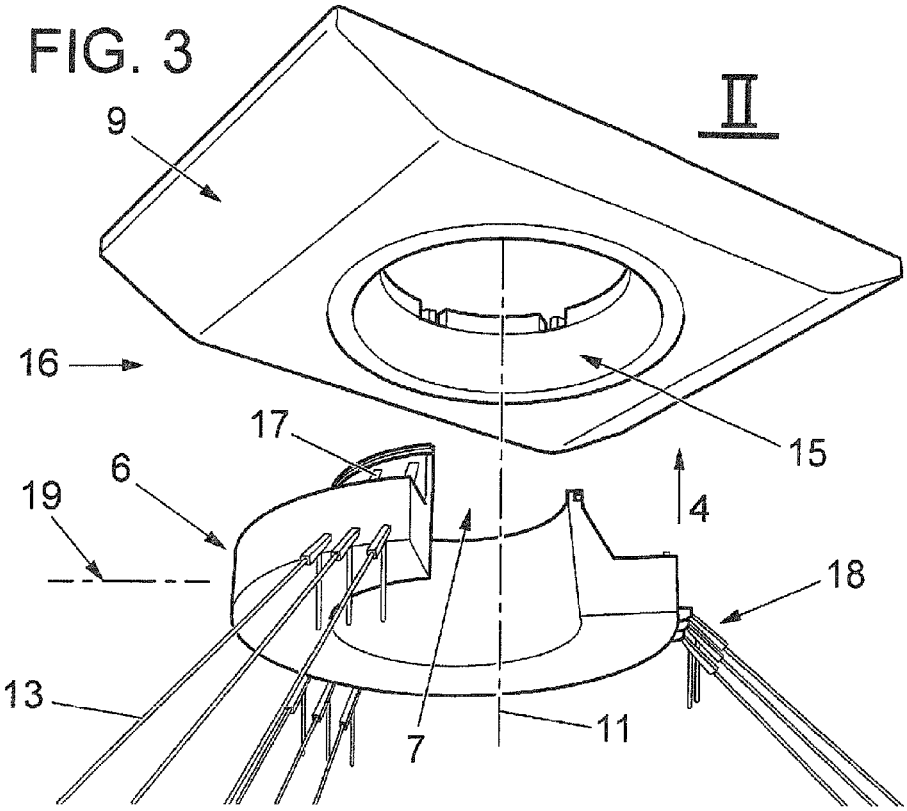
Figure 4:
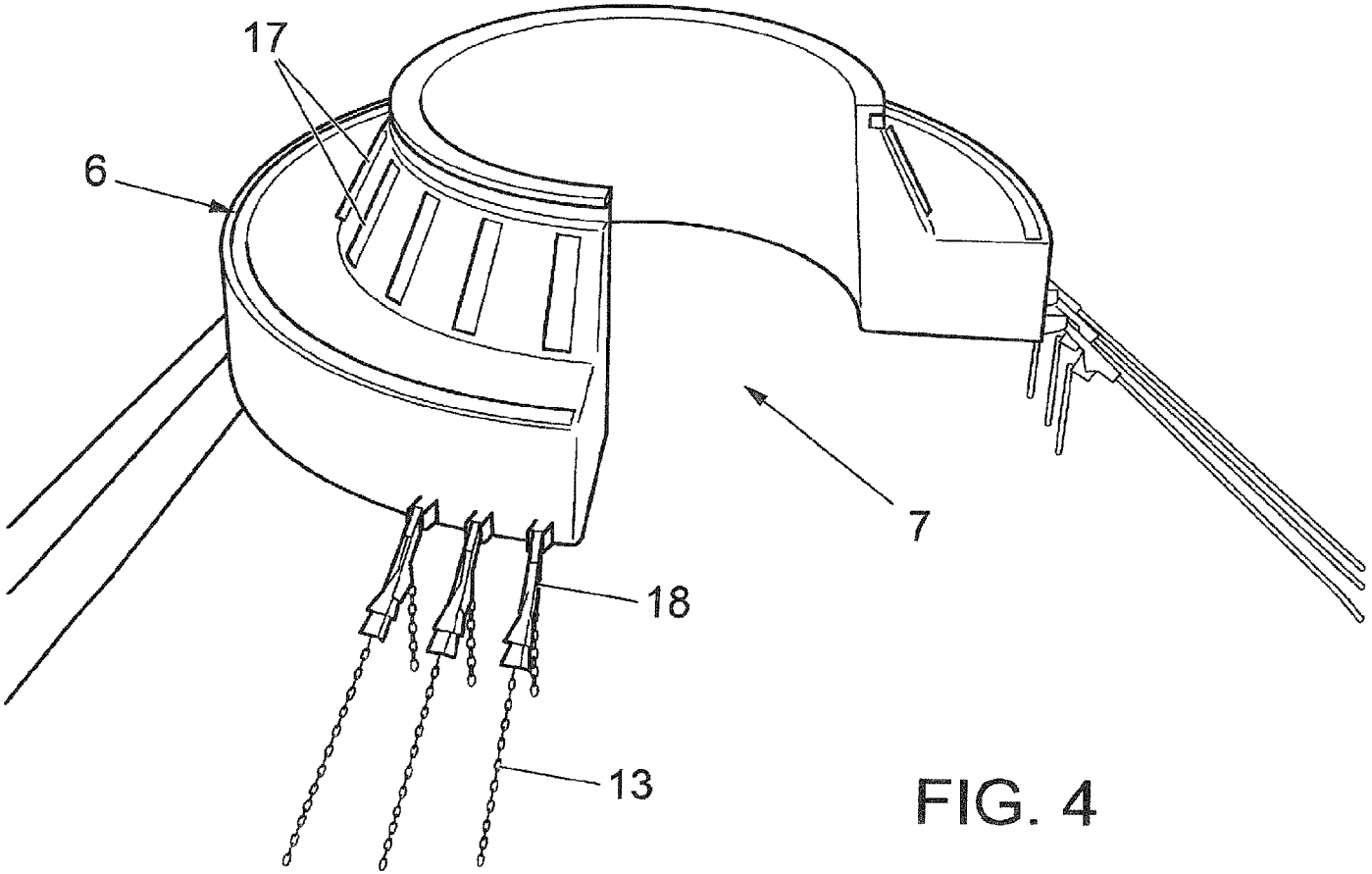
Figure 5:
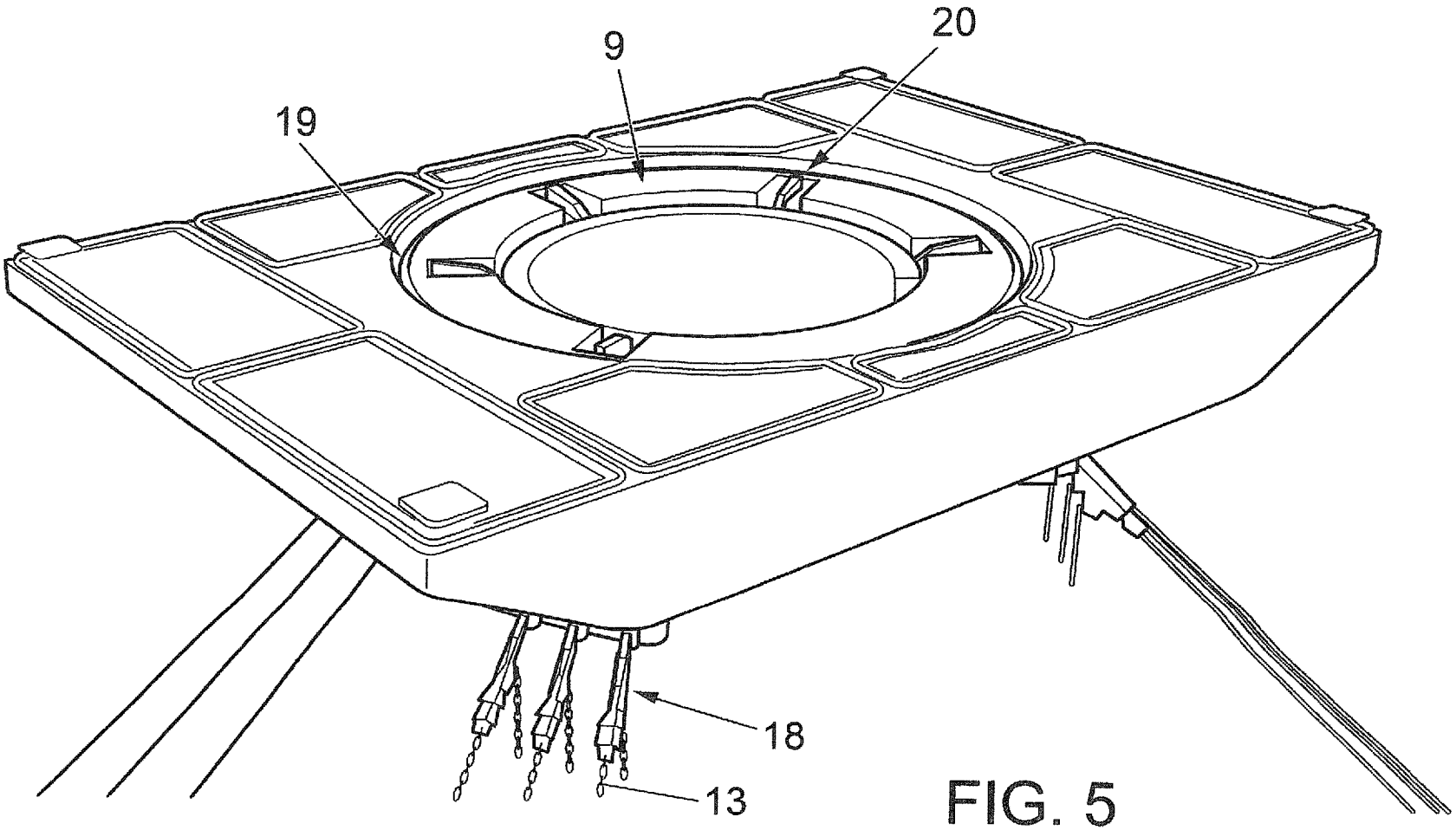
Figure 6:
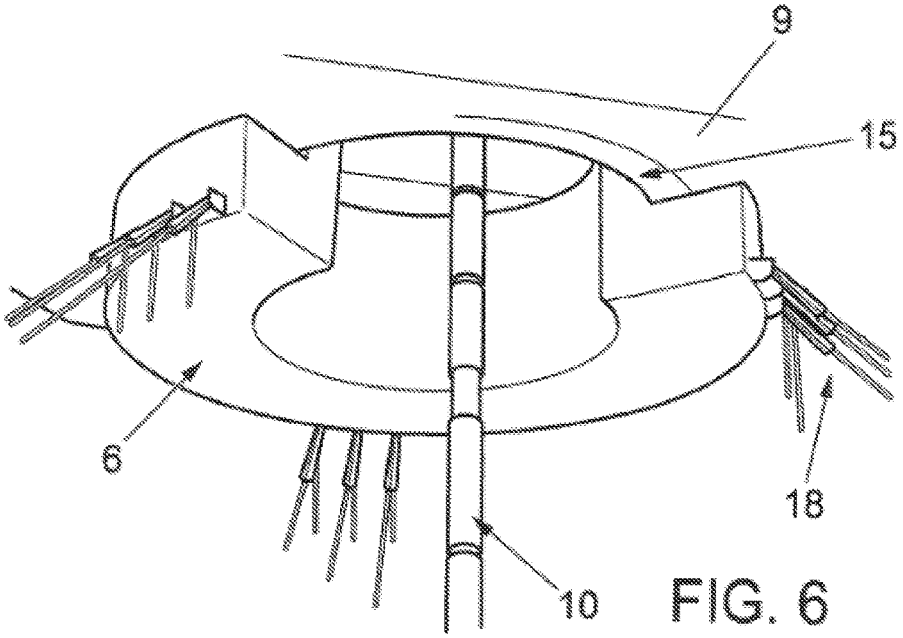
Figure 7:
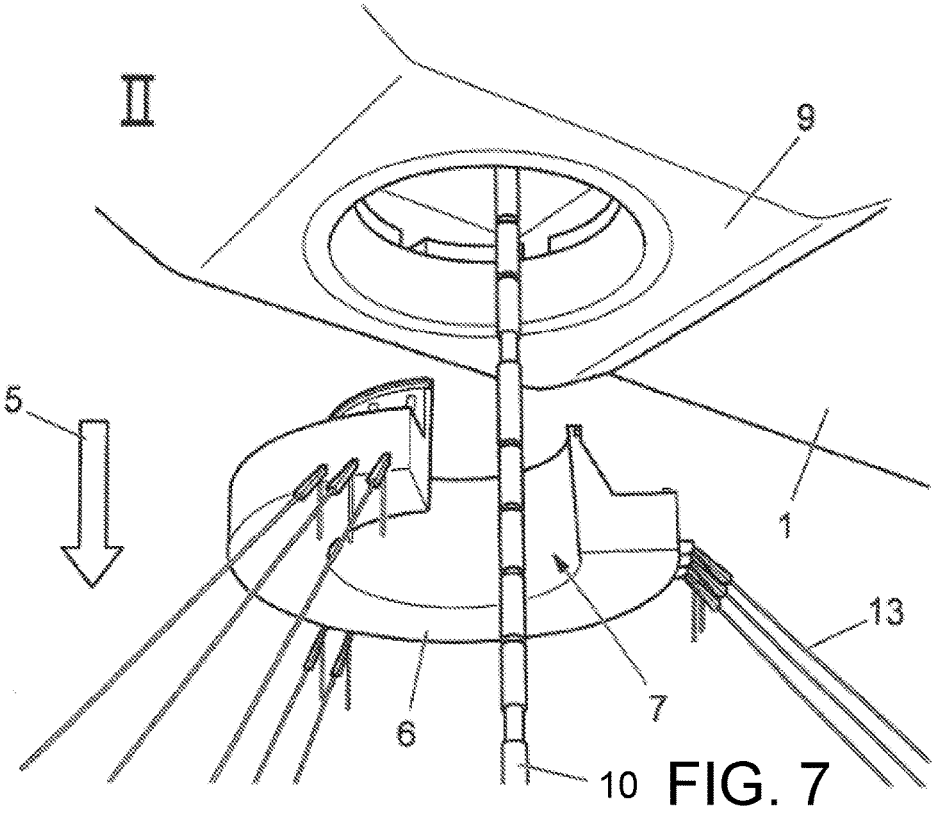
Figure 9:
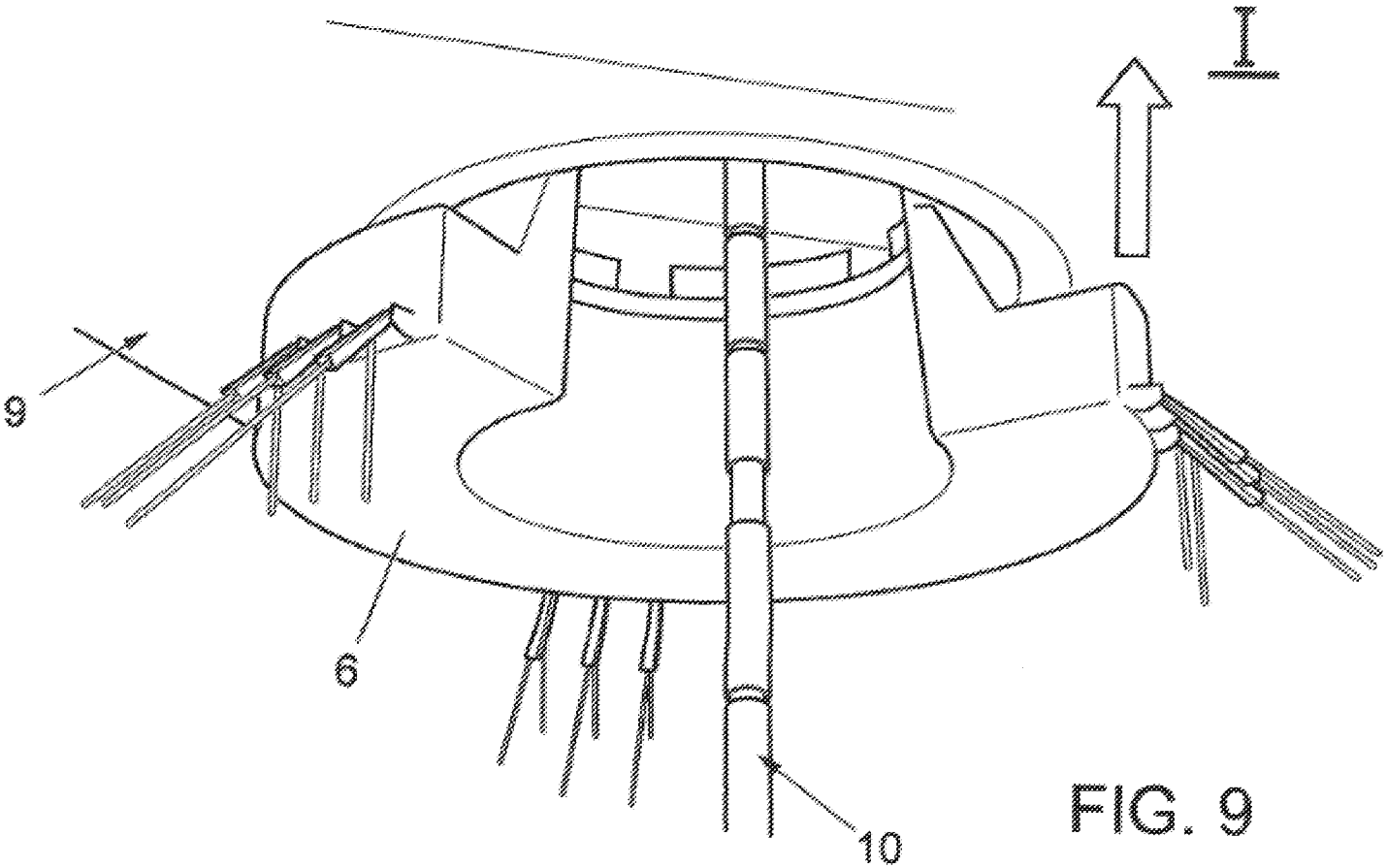

The invention is described in the following with reference to the accompanying drawings, in which FIG. 1 is a perspective view of the invention in active state connected to the underside of the hull of a ship, FIGS. 2-3 illustrate the invention in connected and disconnected state, respectively, seen obliquely from below, FIG. 4 is a perspective view obliquely from above of a disconnected mooring unit, FIG. 5 is a perspective view obliquely from above of a connectable part, which is disconnected from a ship, and with a mooring unit connected to said part, FIGS. 6-8 illustrate various stages from a connected state to a state, in which said mooring unit and the part, which can be connected to a ship, are separated from each other, and FIG. 9 illustrates a state, in which the connectable mooring unit and the connectable part, which can be connected to a ship, can be reconnected to a ship.

A method of accomplishing safe mooring of a ship 1 in a definite position at a distance from land 2 and with possibility to make the ship 1 in question leave the moorage 3 in question for the ship 1 means that the mooring is accomplished by means of a mooring unit 6, which can be raised 4 and lowered 5 and which has a gap 7 seen along its periphery. Further, said mooring unit 6 is so constituted, that it can be connected to I and disconnected from II the ship 1, respectively, by means of a connectable part 9 located below the surface of the water 8. Said mooring unit 6 makes it possible for the ship 1, with downwards protruding load 10 supported by the ship, to pass by said mooring unit 6 after disconnection and lowering of said mooring unit 6, and said unit can rotate in relation to the ship 1 round an essentially vertical imaginary axis 11.

According to the invention said mooring unit 6 is remote-controlled in order to accomplish the desired raising and lowering 4, 5 thereof, and the mooring is accomplished by means of chains 13 or other pulling elements, which are connected to a part 12 anchored in the bottom of the sea. Further, said mooring unit 6, which can be raised and lowered by buoyancy, is releasably connected from below the ship 1 to the moon pool 14 of the ship 1 in question, i.e. an opening of the ship located below the surface of the water, or to another part of the ship 1. Preferably, fastening means 19, 20 are used, which operate with vacuum and excess of displacement. A rotatory bearing 15 adapted to connected mooring unit 6 is received by the connectable part 9.

An arrangement 16 for carrying out a method of accomplishing mooring of a ship 1 in a definite position at a distance A from land 2, and with possibility to make the ship 1 leave the moorage in question of the ship 1, comprises an essentially ring-shaped mooring unit 6, which can be raised and lowered 4, 5 and which has a gap 7 along the periphery, and which exhibits means 19, 20 so that it can be releasably connected to and disconnected from the ship 1 in question, respectively, below the surface of the water 8, and so it can be rotated in relation to the ship 1 round an essentially vertically directed imaginary axis 11. Said mooring unit 6 is constituted by a horseshoe-shaped body, which has a gap in the form of a permanently open opening 7, or an opening, which can be closed on desired occasions, and which is arranged to have the function of a mooring buoy, which can be raised to the desired level 19 in the water. Further, the mooring unit 6 is arranged to be connected to a bearing unit 9, which is supported by the ship 1 below the surface of the water 8 and which comprises a rotatory bearing 15 for the connectable mooring unit 6, and whereby locking means 17, which can be remote-controlled, are arranged to lock the mooring unit 6 to a bearing unit 9, which can be connected to the ship 1 in question and which can be adjusted itself depending on arising environmental forces. The mooring unit 6 exhibits chains 13 or other pulling elements, which are connected to a part 12 anchored in the bottom of the sea, and a mechanism 18 for said chains 13, etc., the length of which is adjustable, and said unit is arranged to be anchored with its opening 7 in a definite direction and at the desired level 19 in the water, by means of for instance said chains 13, etc. The mooring unit 6 has adjustable buoyancy and submerging capacity, respectively, owing to air tank and container therein, which can be filled with liquid, whereby also this function is of use when the level is adjusted, especially when the height of the mooring unit 6 is adjusted.

To sum up, it can be mentioned that the invention makes it possible to moor the ship 1 to the bottom of the sea by means of a separate arrangement 16. The arrangement is so designed, that the ship can adjust itself to the least possible environmental force, so called "weathervaning". The arrangement has a rotary part in order to make "weathervaning" possible. To this rotary part a buoy 6 supporting the mooring system is connected. When all these parts are connected the ship is moored. In certain situations the arrangement is a complement to the DP-system, in other situations the DP-system is a complement to the mooring system. In order to make disconnection possible when for example the riser 10 is mounted, the buoy 6 is provided with an opening 7 to make it possible to move the ship 1 from the definite position without taking up the riser 10 to the ship 1.

The nature and the function of the invention should have been clear from the above description and also from the drawings, which illustrate the nature and the function.

Of course, the invention is not limited to the embodiments described above and illustrated in the accompanying drawings. Modifications are possible, especially as far as the nature of the different parts is concerned, or by using equivalent technique, without departing from the scope of the invention as it is defined in the patent claims.

The invention claimed is:

1. A method of releasably mooring a water-borne ship at a definite position at a distance from land, comprising:

raising or lowering a substantially ring-shaped mooring unit having a gap in a periphery of the mooring unit, wherein the mooring unit is releasably connected to the ship by a connectable part located below a surface of the water and is rotatable around a substantially vertical axis, whereby the mooring unit enables the ship to pass by the mooring unit after the mooring unit is disconnected and lowered when the ship carries a downwardly protruding load.

2. The method of claim 1, wherein the mooring unit is remote-controlled and includes at least one pulling element that is connected to an anchor part anchored below the water.

3. The method of claim 2, wherein raising or lowering the mooring unit comprises changing a buoyancy of the mooring unit, and connecting and disconnecting a rotary bearing of the connectable part to the mooring unit, and the connectable part is fastened to the ship.

4. The method of claim 3, wherein the mooring unit is releasably connected to the connectable part using vacuum.

5. An apparatus for carrying out the method of claim 1, comprising:

a substantially ring-shaped mooring unit, wherein the mooring unit is configured to be raised and lowered, has a gap along a periphery of the mooring unit, and is configured to releasably connect to a connectable part attached to the ship below the surface of the water and to rotate in relation to the ship around the substantially vertical axis.

6. The apparatus of claim 5, wherein the mooring unit includes a body having a closeable gap.

7. The apparatus of claim 5, wherein the mooring unit includes a body that is horseshoe-shaped.

8. The apparatus of claim 5, wherein the mooring unit is configured to connect to a rotary bearing supported by the ship below the surface of the water.

9. The apparatus of claim 8, further comprising a remote-controlled locking device configured to lock the mooring unit to the rotary bearing.

10. The apparatus of claim 5, further comprising at least one pulling element configured to connect to an anchor part anchored below the water, and a mechanism for adjusting a length of the at least one pulling element.

11. The apparatus of claim 10, wherein the mooring unit is configured to connect to the anchor part with the gap disposed in a direction determined by the at least one pulling element.

12. The apparatus of claim 5, wherein a buoyancy of the mooring unit is adjustable by operation of an air tank of the mooring unit, and the mooring unit is configured to submerge by operation of a liquid-fillable tank of the mooring unit.

* * * * *